United States Patent [19]

Mitacek

[11] 4,082,680

[45] Apr. 4, 1978

[54] GEAR OIL COMPOSITIONS

[75] Inventor: Bill Mitacek, Bartlesville, Okla.

[73] Assignee: Phillips Petroleum Company, Bartlesville, Okla.

[21] Appl. No.: 676,260

[22] Filed: Apr. 12, 1976

[51] Int. Cl.[2] ..... C10M 1/19

[52] U.S. Cl. ..... 252/59

[58] Field of Search ..... 252/59

[56] References Cited

U.S. PATENT DOCUMENTS

| | | | |
|---|---|---|---|
| 3,166,541 | 1/1965 | Orzechowski et al. | 252/59 X |
| 3,554,911 | 1/1971 | Schiff et al. | 252/59 |
| 3,630,905 | 12/1971 | Sorgo | 252/59 |
| 3,763,044 | 10/1973 | Anderson | 252/59 |
| 3,772,169 | 11/1973 | Small | 252/59 X |
| 3,793,200 | 2/1974 | Billings | 252/59 X |
| 3,910,856 | 10/1975 | Kruka et al. | 252/59 X |

FOREIGN PATENT DOCUMENTS

| | | | |
|---|---|---|---|
| 769,281 | 3/1957 | United Kingdom | 252/59 |

*Primary Examiner*—Delbert E. Gantz
*Assistant Examiner*—Andrew H. Metz

[57] ABSTRACT

Shear-stable, high viscosity index gear oil formulations are formed by the inclusion into such formulations of a small amount of a hydrogenated butadiene-styrene copolymer having a butadiene content of 30 to 44 weight percent and a weight average molecular weight in the range of about 12,000 to about 20,000.

5 Claims, No Drawings

GEAR OIL COMPOSITIONS

BACKGROUND OF THE INVENTION

This invention relates to improved gear oils, particularly mineral gear oils, and processes for preparing these compositions. In one of its aspects this invention relates to the addition of a small amount of hydrogenated butadiene-styrene copolymer to a gear oil formulation to produce improved formulations that are shear stable and have a high viscosity index (V.I.). In another of its aspects this invention relates to hydrogenated butadiene-styrene copolymers having weight averaged molecular weights within a specified range and also having defined amounts of butadiene and styrene which are blended with suitable mineral oils to produce shear stable gear oils of improved viscosity index.

It is well known from such patents as U.S. Pat. No. 3,554,911 that shear-stable, high viscosity index lubricating oil formulations can be formed by the addition of a small amount of a hydrogenated random butadiene-styrene copolymer having a butadiene content in the range of 30 to 44 weight percent and having a weight average molecular weight in the range of about 25,000 to about 125,000. It has been found, however, that the addition of such copolymers into formulations to be used as gear oils does not produce a gear oil formulation that is shear stable under the temperature and shear conditions met by gear oils in operation. These conditions are sufficiently more severe for gear oils than for crankcase oils that the viscosity of such gear oil formulations rapidly decreases below the acceptable value which has been set at 74 SUS at 210° F (99° C).

It has now, surprisingly, been found that hydrogenated butadiene-styrene copolymers produced similarly to those set out in U.S. Pat. No. 3,554,911, but restricting molecular weight range to less than 20,000 average can be successfully combined into oil formulations to produce shear stable gear oils, that is, oils that retain a viscosity above 74 SUS at 210° F after 50,000 miles of operation. That there is considerable difference in gear oil formulations and lubricating oil formulations can be well appreciated by comparing the fact that a successful gear oil must hold its viscosity characteristics after 50,000 miles of operation while the normal lubricating crankcase oil is expected to be changed after about 2,000 miles of operation.

It is therefore an object of this invention to improve gear oils, particularly the shear stability of mineral gear oils. It is another object of this invention to improve gear oils by adding specific hydrogenated random copolymers thereto. It is still another object of this invention to provide new and improved shear stable gear oil formulations.

Other aspects, objects and the various advantages of this invention will be apparent upon reading the specification and the appended claims.

STATEMENT OF THE INVENTION

In accordance with the invention, shear-stable gear oil formulations result from the inclusion of a small amount of a hydrogenated butadiene-styrene copolymer having a butadiene content of about 30 to about 44 weight percent and a weight average molecular weight in the range of about 12,000 to about 20,000. At present, it is preferred that the additives of the invention be employed in an amount in the range of about 3 to about 10 weight percent of the finished gear oil composition. One skilled in the art, having studied this disclosure, can routinely determine the optimum proportion of copolymer for his purpose.

The copolymers or additives of this invention have a molecular weight in the range of about 12,000 to about 20,000 with the now preferred range of weight average molecular weight being about 13,000 to about 19,000. The copolymer is one containing from about 30 to about 44 parts by weight butadiene per hundred parts by weight of total monomers. The values for butadiene content of the polymers are actually those for the butadiene in the monomer charge. These values are, however, very close to those for the butadiene content of the polymers because essentially complete conversion is obtained in polymer synthesis runs. The copolymers have a vinyl content before hydrogenation of less than 35 weight percent. During hydrogenation, unsaturation is reduced to 5 weight percent or less, and phenyl group remain essentially unhydrogenated.

The copolymers of the present invention can be prepared by the technique set forth in U.S. Pat. No. 3,554,911, Sidney Schiff et al, issued Jan. 12, 1971 which refers to the conventional techniques known in the art, such as those described in U.S. Pat. No. 2,975,160, R. P. Zelinski, issued Mar. 14, 1961, in which, for example, a mixture of butadiene and styrene monomers are polymerized using butyllithium as a catalyst and tetrahydrofuran as a randomizing agent. The hydrogenation can be carried out in any manner known in the art, such as by the processes of U.S. Pat. No. 2,864,809, R. V. Jones et al., issued Dec. 16, 1958, or U.S. Pat. No. 3,113,986, D. S. Breslow et al., issued Dec. 10, 1963, or U.S. Pat. No. 3,205,278, S. J. Lapporte, issued Sept. 7, 1965. For example, the copolymer can be hydrogenated over a reduced nickel-kieselguhr catalyst or over a nickel octoate-triethylaluminum catalyst system. The hydrogenated butadiene-styrene copolymers of this invention are polymers which have been sufficiently hydrogenated to remove substantially all of the olefinic unsaturation, to less than about 1 weight percent, leaving only the aromatic, that is, the phenyl group unsaturation.

In the preparation of lubricating compositions, including gear oils, various mineral oils are employed. Generally, these are of petroleum origin and are complex mixtures of many hydrocarbon compounds. Preferably, the mineral oils are refined products such as are obtained by well-known refining processes, such as by hydrogenation, by polymerization, by solvent extraction, by dewaxing, etc. Frequently, the oils have a Saybolt viscosity of 100° F (38° C) in the range of about 60 to 5,000 and a Saybolt viscosity of 210° F of about 30 to 250. The oils can be of paraffinic, naphthenic, or aromatic types, as well as mixtures of one or more types. Many suitable lubricating compositions are available as commercial products.

In addition to the additives of this invention, the shear-stable gear oils can comprise one or more other additives known to those skilled in the art, such as antioxidants, pour point depressants, dyes, detergents, etc. Commonly used are gear oil additives containing phosphorus and sulfur. To be of commercial interest as a gear oil, the viscosity is measured by ASTM D44574 and must be 74 SUS at 210° F as a minimum. It cannot be over-emphasized that since the shearing stress in an axle is much more severe than in an automobile engine that the use of lower molecular weight polymers which are more shear-stable than the higher molecular weight polymers is essential to the formulation of multi-grade gear oils that can be depended upon to stay in-grade after considerable use.

EXAMPLE I

A shear-stable gear oil was prepared with the following formulation:

Ingredients 51.1 wt. % Neutral oil 10H — Viscosity at 100° F=95 SUS — Viscosity Index 100 (KC-10)

36.0 wt. % Bright Stock oil 250H — Viscosity at 210° F=205 SUS — Viscosity Index 96 (KC-250)

7.0 wt. % Gear Oil additive containing Phosphorus and Sulfur (Anglamol 99LS, Lubrizol Corp.)

0.2 wt. % Polymethacrylate pourpoint depressant — (Acryloid 152 — Rohm & Haas)

5.7 wt. % Butadiene-styrene hydrogenated copolymer

The butadiene-styrene copolymers of this invention were made by first copolymerizing styrene and butadiene using butyllithium catalyst and this polymer was then hydrogenated as described in Example I of U.S. 3,554,911, as follows:

The hydrogenated polymer for this example was prepared using the following recipe and conditions:

| | Parts by weight |
|---|---|
| Butadiene | 35 |
| Styrene | 65 |
| Cyclohexane | 800 |
| Tetrahydrofuran | 1.5 |
| Sec-butyllithium | 0.154 |
| Initiation temperature, ° F | 122 (50° C) |
| Initiation pressure, psig | 20 (138 kPa) |

Charge order was cyclohexane, reactor purged with nitrogen, butadiene, styrene, tetrahydrofuran, and sec-butyllithium. Essentially quantitative conversion was obtained in 3 hours. At that time the unterminated product was transferred to a hydrogenation reactor, 0.13 g of nickel (as nickel octoate) and 1.05 g of triethylaluminum in cyclohexane were added, the reactor was pressured to 50 psig (345 kPa) with hydrogen, the temperature was increased slowly to 350° F (177° C), the hydrogen pressure was increased to 400 psig (2760 kPa) and the temperature rose quickly to 395° F (201.5° C) and fell to 350° F (177° C) in about 30 minutes. Reaction was continued for 1.5 hours at 350° F and 400 psig, the reactor was cooled to 170° F (77° C), and the essentially completely hydrogenated polymer was recovered. With respect to the polymers in this and succeeding examples, "essentially completely hydrogenated" means that 95 weight percent or more of the olefinic groups are hydrogenated and 5 weight percent or less of the phenyl groups (when present) are hydrogenated.

The unhydrogenated polymer had the following properties:

| | |
|---|---|
| Unsaturation: Trans % | 16.1 |
| Vinyl | 9.6 |
| Molecular weight $\frac{Mw}{Mn} \times 10^{-3}$ | $\frac{17.5}{14.1}$ |
| Total styrene wt. % | 63.5 |

The hydrogenated polymer had the following properties:

| | |
|---|---|
| Unsaturation: Trans % | 1.5 |
| Vinyl % | nil |
| Molecular weight $\frac{Mw}{Mn} \times 10^{-3}$ | $\frac{16.4}{13.1}$ |

The test gear oil was charged to the differential of two 1972 Buick Skylarks running on mileage accumulators. Viscosities were measured at intervals. The results are given below:

| Oil Miles | Viscosity SUS/210° F | Oil Miles | Viscosity SUS/210° F |
|---|---|---|---|
| 0 | 94.76 | 0 | 94.84 |
| 8,492 | 87.74 | 13,841 | 85.39 |
| 29,689 | 83.21 | 33,676 | 81.48 |
| 46,871 | 80.93 | 54,776 | 78.80 |

From the tests it was concluded that the gear oil would have a viscosity SUS 210° F above 74 after 50,000 miles operation as required by the specification for this type of gear oil.

EXAMPLE II

For comparison, gear oil was formulated as above, using higher molecular weight hydrogenated styrene-butadiene copolymer produced in the manner of U.S. Pat. No. 3,554,911. These tests were made on a 1970 Plymouth used as a mail transporting car between Borger, Texas and Bartlesville, Okla. The results are tabulated below.

TABLE II

| Mol. Wt. of Polymer | Concentration wt. % | Miles in service | Viscosity SUS at 210° F |
|---|---|---|---|
| 65,000 | 2.07 | 0 | 87.6 |
| | | 12,408 | 67.5 |
| 47,500 (Mn) | 2.7 | 0 | 87.4 |
| | | 31,467 | 67.8 |
| 22,500 (Mn) | 3.8 | 0 | 86.0 |
| | | 26,099 | 71.6 |

The table shows that the gear oil viscosity fell below the specification value of 74 at 210° F after only 12,400, 31,500, and 26,100 miles of operation, respectively, using the higher molecular weight polymers.

I claim:

1. Shear-stable, gear oil compositions comprising a mineral lubricating oil containing a shear-stabilizing amount of a soluble hydrogenated butadiene-styrene copolymer dissolved therein, said copolymer having a butadiene content of about 30 to about 44 weight percent with the remainder being styrene and a weight average molecular weight within the range of from about 12,000 to about 20,000.

2. A composition according to claim 1 wherein the hydrogenated butadiene-styrene copolymer has an olefinic unsaturation of 5 weight percent or less.

3. A composition according to claim 1 wherein said copolymer has a weight average molecular weight in the range of about 13,000 to about 19,000.

4. A composition according to claim 1 wherein said copolymer is present in an amount in the range of about 3 to about 10 weight percent of the total gear oil composition.

5. A composition according to claim 1 wherein the copolymer has an olefinic unsaturation of less than 1 weight percent.

* * * * *